United States Patent [19]

Jastram et al.

[11] 3,951,094

[45] Apr. 20, 1976

[54] GAS-DRIVEN, PULSATING WATER JET PROPULSIVE DUCT DRIVE FOR WATERCRAFT

[75] Inventors: Claus Jastram, Hamburg; Fritz Weiss, Ahrensburg; Hans Voss, Hamburg, all of Germany

[73] Assignee: Jastram-Werke GmbH KG, Hamburg, Germany

[22] Filed: Oct. 15, 1974

[21] Appl. No.: 514,147

[30] Foreign Application Priority Data

Oct. 15, 1973 Germany ..... 2351750
Sept. 19, 1974 Germany ..... 2444749

[52] U.S. Cl. ..... 115/15; 60/221
[51] Int. Cl.[2] ..... B63H 11/06
[58] Field of Search ..... 115/11, 13, 15; 60/221, 60/222, 220 R, 270 R

[56] References Cited

UNITED STATES PATENTS 2,903,850 9/1959 Lang ..... 60/221
3,024,598 3/1962 Saurer et al. ..... 60/221
3,386,246 6/1968 Sugimura ..... 60/221

*Primary Examiner*—Trygve M. Blix
*Assistant Examiner*—Gregory W. O'Connor

[57] ABSTRACT

The invention relates to a gas-driven pulsating water jet propulsive duct drive for watercraft with a propulsive duct which has at the front end an inlet aperture for water with a closure member closing and opening periodically by means of a drive device, is open at the rear end for ejection of water and comprises at the front end a power gas outlet behind the inlet aperture. With propulsive duct drives of this kind the forward inlet aperture of the water-filled propulsive duct is periodically closed, the power gas outlet opened, in order to feed power gas under pressure into the propulsive duct and to expel the fluid filling of the propulsive duct rearwards, the power gas outlet is closed and the forward inlet aperture opened again for a fresh fluid filling.

12 Claims, 4 Drawing Figures

1
2
3
4
5
6
7
8
9
10
11
12
13
14
15
16
17
18
19
20
23
24
25
26
28
30
31
32
33
34
35
36
37

GAS-DRIVEN, PULSATING WATER JET PROPULSIVE DUCT DRIVE FOR WATERCRAFT

In a known propulsive duct of this kind (German Auslegeschrift 1 122 403, French Pat. Specification No. 1 043 920, British Pat. Specification No. 700,393) the closure member and the rim of the inlet aperture co-operating with this are formed as a valve disc and valve seating. The pressure of the power gas acting behind the closure member impels this forward on to the valve seating and holds it closed as long as the over-pressure of the power gas lasts in the propulsive duct. Although this principle of operation appears to be very simple and effective, success has been denied to it. With the movement of the closure member a considerable dead space is produced in which the pressure gas expands with considerable loss. Too great a quantity of water must be impelled by the closure member, whereby heavy losses and a pulse against the direction of travel occur. Only a very low working frequency can be attained so that the power and mean thrust are too small in relation to the weight of the machine. As the closure member only gradually closes and therefore the outlet apertures for the power gas are only gradually opened, the power gas only gradually and with considerable choke losses enters into the propulsive duct. The total losses are so great that the known propulsive duct is useless in practice.

The object of the invention is to increase the degree of efficiency, the frequency and the power.

This object is attained in accordance with the invention in that the closure member takes the form of a flat slide member.

Admittedly flat slide members are known as closure members in other fields of engineering; but in the present instance of use, however, advantages on which an invention could be based have surprisingly appeared. As the closure movement of the slider substantially completes its extension parallel to the surface, the impelling volume of the closure member is reduced by contrast with the closure member of the known propulsive duct to a low percentage. The loss impulse is also correspondingly reduced. The dead space expansion is avoided. The efficiency factor of the propulsive duct is substantially increased, for the following reasons in fact. First of all the gas flow takes place predominantly with the flow cross-section fully opened without any choke losses, as the slider because of its low impelling volume can be opened abruptly. Secondly the loss expansion of the power gas is considerably reduced due to the extensive reduction of the dead space. Thirdly the fluid outthrust from the propulsive duct at high frequencies more closely approaches the ideal piston outthrust, by which not only are the hydraulic losses reduced but also heat losses when using hot power gases. A further advantage of the invention lies in the reduction of the masses of the closure member moved, which because of the extraordinary high closure forces on encountering the closure member on the rim of the aperture, are of great importance.

The inlet aperture is advantageously annular and the slide valve hollow-cylindrical. This gives a centrally symmetrical power equilibrium, which protects the slider from deformations and the slider guides from excessive load under the forces acting in a vicinity of the inlet aperture. The inlet aperture can be formed between the front rim of the propulsive duct and a body containing the drive device for the slider.

It is advantageous if the inlet aperture is located in a lateral and substantially parallel outer surface over which the water flows, and if the slider is disposed substantially in this surface. In this way that is to say there is obtained during the transition of the slider from the open to the closed position (and vice versa) only a trifling deflection of the water flow with correspondingly low losses. If the propulsive duct can be disposed separately from the ship's body, this constructional principle is advantageously carried into effect by the body containing the drive device for the slider being disposed for the greater part in front of the forward rim of the propulsive duct, and the inlet aperture being made annular between the front propulsive duct rim and the body. The body and the front rim of the propulsive duct can be made in reciprocal synchronization so as to favour the flow of fluid. If on the contrary the propulsive duct is integrated into the general shape of a watercraft, the inlet aperture and the slider are preferably disposed in the outer surface of a watercraft to be driven.

The body containing the drive device for the slider can however also be an insert body disposed inside the forward zone of the propulsive duct.

According to the invention the co-operating sealing surfaces on the slider and on the inlet aperture of the propulsive duct are completely free from the closure forces, since the sealing surface of the slider is formed by a surface extending substantially parallel to the direction of its closure movement. In other words the slider does not abut frontally on a mating sealing surface, but travels past this at a small distance away. If the slider is made as a hollow cylinder, there is preferably used as a mating sealing surface a boundary surface, turned radially inwards or outwards, of the front rim of the propulsive duct. Here the slider projects at the end of the closure movement at the mating sealing surface of the propulsive duct rim into space, the closure occurring at the instant at which the slider reaches the propulsive duct rim. The slider need not then be stopped abruptly, but can move on further, so that the closure is continuously maintained. This construction has not only the advantage that the closure and inertia forces are reduced, but also that the opening times of the slider are shortened as it does not have to be braked before reaching the mating sealing surface and since furthermore the opening movement can continue to be accelerated as long as the closure condition still exists; at the instant in which the slider leaves the mating sealing surface it already has a considerable velocity.

In many cases a separate sealing device between the slider and the mating sealing surface is not required, as the closure is itself practically effective when a small opening gap remains between these two parts in the closure position. However according to the invention it is possible to provide one of the sealing surfaces with a sleeve seal.

Furthermore the sealing action between the slider and the mating sealing surface can be improved if the forward rim of the slider travels in a groove of the mating sealing surface. Here the groove is advantageously made sufficiently deep for no body contact to occur between the slider and the mating sealing surface. The groove is further advantageously given so much clearance that the fluid contained therein as the slider pushes in, can escape without an impermissibly high pressure build-up taking place.

For arresting the closing and/or opening movement of the slider, there are preferably provided resilient and/or damping devices. It has been found particularly advantageous if these devices are formed by a gas-filled chamber jointly formed by surfaces of the slider and of the body guiding the slider, which becomes smaller because of the movement to be damped and in the vicinity of that part of the travel in which the damping has to be effective, is substantially closed. Outside this part of the path of travel the said damper should be connected with other spaces for discharging.

While with the abovementioned known propulsive duct the gas discharge in the propulsive duct is initiated at the instant in which the closure member begins its opening movement, which has the disadvantage that the power gas can escape past the closure member as mentioned above, the rapid control movement of the slider in accordance with the invention makes it possible for the discharge of the power gas in the propulsive duct only to begin when the inlet aperture of the propulsive duct is nearly or completely closed. This is advantageously effected by the slider being connected with a member for controlling the power gas discharge in the propulsive duct. This member need not be a separate component, as the slider is normally provided with a guide component which can simultaneously form this member.

The actuation of the slider can be effected by motor in any desired manner, for example, by pneumatic pressure of the power gas on piston surfaces directly or indirectly connected to the slider.

In is of course possible to generate the power gas intermittently in a rhythmic cycle or to make the quantity of gas required for a working cycle available in a rhythmic cycle from a large supply source. It is however preferable if there is provided between the power gas source and the apertures for the discharge of the power gas in the propulsive duct a gas collector adapted in dimensions to the quantity of gas to be ejected during each propulsion cycle, as is known per se. As this gas collector can be disposed in the immediate vicinity of the outlet apertures outside or inside the propulsive duct, the flow resistancies which the gas encounters in its path in the propulsive duct can be considerably reduced. It is also possible to obtain through the volume of the gas collector a restriction of the quantity of gas to be ejected at each cycle, without complicated control devices being required for this. The feed of the power gas to the collector can be controlled in different ways, for example by a shut-off member, whose opening time is either constant or can be adjusted at will, or is even proportional to the cycle time. The shut-off member can also be controlled independently of the pressure in the gas collector, so that the gas feed is ended in each case on reaching a given debit pressure. There may also be provided a simple choke in the path from the power gas source to the gas collector, which if requisite is adjustable, so that in accordance with a further feature of the invention the filling speed of the gas collector is adjustable. This is particularly advantageous if the drive of the slide valve in accordance with the invention is controlled independently of the pressure in the gas collector, i.e. that the closure movement of the closure member and the succeeding ejection of the power gas in the propulsive duct is initiated in each case automatically when the pressure in the gas collector has reached a given value.

Since the quantity of power gas ejected at each cycle in the propulsive duct is limited by the volume of the gas collector, and thus slipstream losses are avoided, the power gas feed to the gas collector is preferably shut off during the ejection of the power gas in the propulsive duct. This can be effected in accordance with the invention by means of a closure component connected to the slider.

The motorised actuation of the slider is effected in accordance with the invention by the action of the pressure in the gas collector on a piston surface connected to the slider. Preferably however precautionary measures are adopted in this connection to ensure an abrupt actuation of the slider in spite of the gradually rising pressure in the gas collector. This is preferably effected by means of a control member disposed between the gas collector and the piston surface, which when a given pressure in the gas collector is exceeded, abruptly frees access to the piston surface.

The automatic control of the slider independently of the pressure in the gas collector is very advantageous for many instances of application. If however the pressure in the gas collector should be varied independently of the frequency, or the movement of the slider should be controlled directly (for example in the case of a control, synchronized with one another, of a multiplicity of propulsive ducts) there is advantageously provided a positively-controllable (e.g., time and/or pressure controlled) control member between the gas collector or the other pressure gas source and the piston surface of the slider.

The invention will be explained in what follows in more detail with reference to the drawing, which illustrates four advantageous examples of embodiment. In this:

Figure 1:
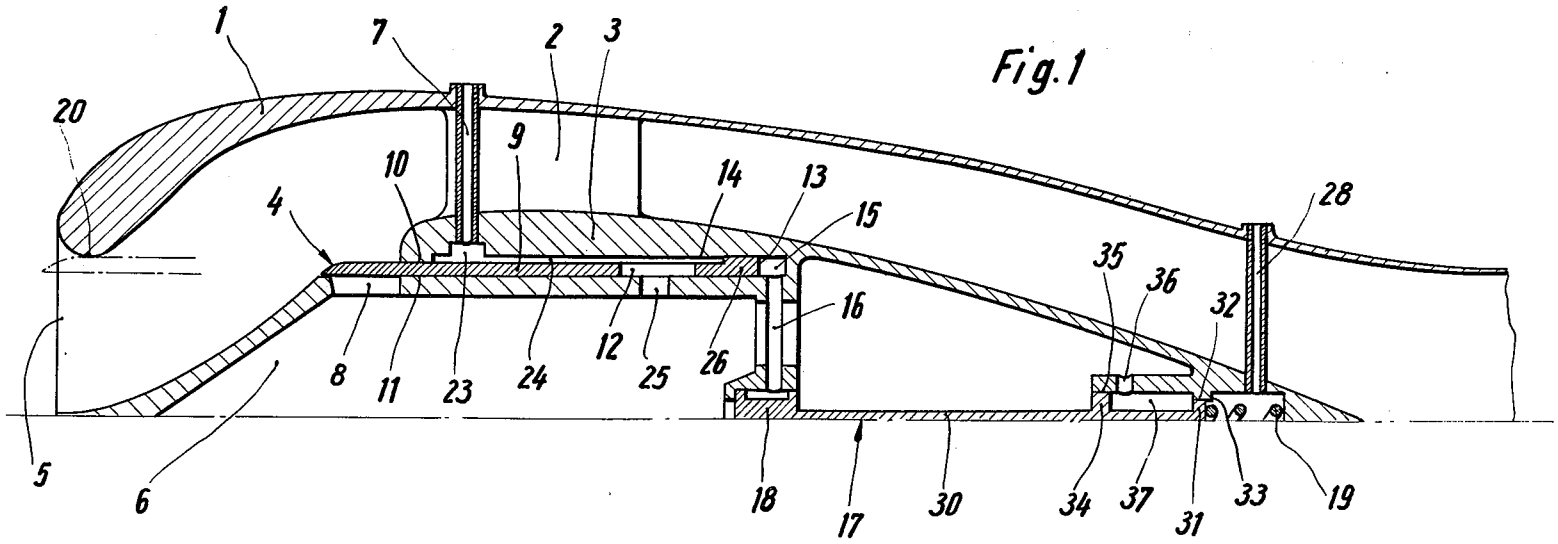
FIGS. 1 and 2 are longitudinal sections through the front part of two propulsive ducts with insert bodies disposed inside the propulsive duct for the guidance and drive of the slider.
Figure 2:
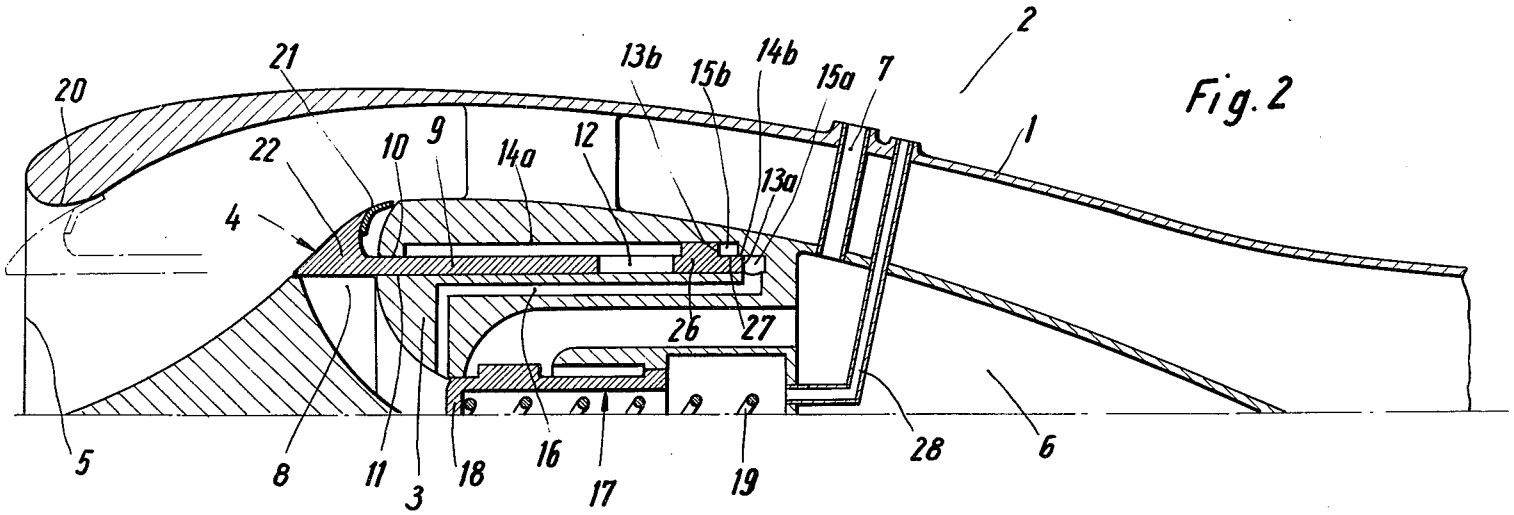

The following features are common to the examples of embodiment in both FIGS. 1 and 2.

The wall 1 bounds on the outside the annular channel 2 of the front part of the propulsive duct round a body 3, which guides the slider 4, which is represented in each case in the open position of the propulsive duct and is indicated in chain line in that position in which it closes the inlet aperture 5 of the channel 2 of the propulsive duct. All the parts are substantially designed as coaxial bodies of rotation. They may however also have a different form from a form of rotation, inasmuch as only the insert 3 with the slider 4 is arranged in such a way that the latter is removed from the channel 2 in the drawn-back position, while in the moved-forward position it closes the aperture 5.

The body 3 inserted in the propulsive duct contains a gas collector 6, i.e., a storage chamber for the power gas which can be connected via a channel 7 to an outer power gas source (not shown). Such a power gas source is for example a compressed air supply or a pressure or combustion gas generator which supplies the power gas at a given pressure. The gas collector is further connected via apertures 8 to the channel 2 of the propulsive duct, these apertures being closed by the slider 4.

The slider 4 is guided coaxially with a rear cylindrical part 9 in the insert body 3 between corresponding cylindrical surfaces 10 and 11 of the body. The guide part 9 of the slider contains apertures 12 which in the pushed-forward position of the slider (chain line) in which it co-operates closingly with the aperture 5, are in alignment with the apertures 8 and thereby produce the connection between the gas collector 6 and the channel 2 of the propulsive duct.

At the rear end the guide part 9 of the slider 4 forms a piston surface 13 which is located in the cylindrical chamber 15 formed between the coaxial cylindrical surfaces 11 and 14 of the insert body 3. This cylindrical chamber 15 is connected via a bore 16 in a manner differing in different forms of embodiment, to the gas collector 6, in which connection however there is located in the path of connection between the bore 16 and the gas collector 6 a control member 17, whose closure component 18 under the influence of a spring 19 is normally located in the closed position and thus shuts off the path of connection.

The special features of the individual examples of embodiment are described in what follows.

The slider of FIG. 1 is made externally and internally cylindrical in both its front part and also in its guide part 9. No separate sealing device is provided. In the closed position shown in chain line it co-operates sealingly with the narrowest zone 20 of the inlet aperture 5 of the propulsive duct. A narrow gap is provided between the outer diameter of the slider and the inner diameter of the aperture 5, which ensures friction-free operation, but however is so slight that no noticeable quantities of the power medium can escape at the front end of the propulsive duct. By contrast the slider of the apparatus of FIG. 2 is provided with a sealing sleeve 21 which can co-operate with the component 20 of the aperture 5 and produces a complete sealing against overpressure in the channel 2.

While the guide part 9 of the slider of FIG. 1 has the same overall diameter as the front part of the slider closing off the aperture 5, the latter in the case of FIG. 2 is made with a thickened portion 22 of increased diameter, so that an underpressure prevailing in the channel 2 can act to return the slider.

While in the case of FIG. 2 of the channel 7 is in direct connection with the gas collector 6, this channel opens in the case of FIG. 1 into an annular groove 23 which is cut in the cylindrical wall 14 of the insert body 3. The diameter of the wall 14 is somewhat greater than that of the guide wall 10, so that between the outer surface of the guide part 9 and the wall 14 a gap 24 is formed connecting the annular groove 23 with the apertures 12 of the guide part 9. In the part of the insert body 3 forming the guide wall 11 there are located apertures 25 which are in alignment with the apertures 12 in the retracted position of the slider 4. In the retracted position of the slider there exists therefore a flow connection between the channel 7, via the annular groove 23, the annular chamber 24, the bores 12 and the bores 25, and the gas collector, through which the power gas can flow into the gas collector from the exterior power gas source.

In both forms of embodiment there is provided at the rear end of the guide part 9 of the slider 4 an exteriorly or interiorly thickened piston component 26 co-operating with the guide wall 14 and on whose rear side is located the piston surface 13. In the case of FIG. 1 this piston surface is undivided, while in the case of the apparatus in FIG. 2 it is made stepped in the form of an annular surface 13*a* of lesser diameter and an annular surface 13*b* of greater diameter, of which surfaces the surface 13*a* lies further behind than the surface 13*b* and wherein these surfaces are interconnected by a cylindrical surface 27. The cylindrical surfaces 14, 14*b* of the insert body 3 surrounding them are also made correspondingly stepped, so that the cylindrical chamber 15 which is in one part in the other form of embodiment, is made in the case of the form of embodiment in FIG. 2 divided into two parts, that is to say into a cylindrical chamber 15*a*, directly connected to the bore 16, and a cylindrical chamber 15*b*, which in the retracted position of the slider is not directly connected to the bore 16. This connection is not produced until the slider has retracted a small part of its opening movement. During the closure process the air enclosed in the chamber 15*b* acts as a buffer and damps the movement of the slider 4.

The control members 17 are made differently so that when a given pressure in the gas collector is exceeded they open. For this purpose the cylindrical chamber of the slider is connected with a control slider or slide valve. The control sliders shown in both examples of embodiment are constructed similarly. It is sufficient therefore to describe the construction and mode of operation of the control slider of FIG. 1.

The closure component 18 of the control slider is fixedly connected by means of a shank 30 with a piston 31, which co-operates with a cylindrical surface 32 fixed in position and which forms slightly behind the piston 31 in the closed position of the valve at the control edge 33 and behind this a chamber connected with the periphery through the channel 28. In front of the piston 31 there is located at a distance away a second piston 34 somewhat larger in diameter and which works in a cylindrical surface 35 fixedly connected to the cylinder 32 and enclosing with this between the two pistons a chamber 37 connected via an aperture 36 to the gas collector 6.

When the gas collector 6 is connected to the gas source, the pressure in the gas collector is transmitted through the aperture 36 into the chamber 37, while the pressure in the chamber located behind the piston 31 remains low. A force acts therefore on the front surface of the piston 31 which tends to open the valve. On reaching a given degree of pressure this force exceeds the force exerted by the compression spring 19 producing a tendency to closure, and the valve begins to open. This means that the piston 34 travels across the aperture 36, by which the chamber 37 is separated from the gas collector. Next the piston 31 travels across the control edge 33, by which the chamber 37 is emptied into the space lying behind the piston 31 and hence into the free air, so that the power gas pressure now still acts only on the front surface of the piston 34 and — as this is greater than that on the piston 31 — the control member 17 tears away completely abruptly. This process can be assisted still further in that the gas collector pressure also acts on the front surface of the closure component 18. When the pressure in the gas collector sinks, the spring 19 exerts a force tending to closure. This process is repeated at each cycle of operations.

The control member of the example of embodiment in FIG. 2 acts on the connection of the gas collector with the apertures 8 or with the channels 16. In the example of embodiment in FIG. 1 the control member only acts on the channel 16, while the apertures 8 are only closed by the slider 4. The mode of operation is however to a large extent similar, as is described — firstly with reference to FIG. 1 — in what follows.

The power gas flows from a pressure source (not shown) through the channel 7, annular groove 23, annular chamber 24, bores 12 and bores 25 in the retracted condition of the slider 4, into the gas collector 6. When a given pressure in the gas collector is exceeded the control member 17 opens in the manner described the connection between the gas collector and the channel 16, by which pressure is exerted on the cylindrical chamber 15 and the slider is moved in the direction of closure.

During the closure movement the apertures 12 and 25 move rapidly away from one another, so that the connection of the channel 7 with the gas collector 6 is rapidly interrupted. In this way any further feed of gas to the gas collector during the further progress of operations and in particular during the ejection of the power gas out of the gas collector, is prevented. As soon as the front edge of the piston component 26 travels past the front edge of the annular groove 23 a space is enclosed between the piston component 26 and the front end of the annular chamber 24, in which any further movement of the slider in the closure direction results in a compression of the gas enclosed and hence to a buffer effect. The movement of the slider is therefore gently but effectively braked. As the space enclosed however, because of unavoidable play, also has a connection with the channel 2 of the propulsive duct and the annular groove 23, compressed gas escapes from this space, so that it is not possible to convert the full compression energy into an impulse driving back the slider. The spring and damping actions can be adjusted to one another is desired manner through the choice of dimensions of the space and the size of the play or clearance through which the space is connected to the ambient atmosphere. The dimensions of the space and the way in which it is connected to the ambient atmosphere best suited for the particular instance of application can easily be determined by tests.

When the slider has reached its closure position, shown in chain line, the apertures 12 of the guide component 9 come into communication with the apertures 8 of the gas collector. The power gas is then discharged out of the gas collector into the channel of the propulsive duct so as to expel the water contained therein. The return movement of the slider 4 is initiated by the pressure buffer which has built up during the closure process at the front side of the piston 26, and which can be assisted by springs or the like (not shown). Furthermore the power gas pressure likewise acting, after a slight return motion travel, on the front side of the piston 26 from the bore 7, also acts in the closure direction. With the return movement of the slider the starting condition is again initiated and the cycle of operations begins anew.

In the example of embodiment in FIG. 2 the gas collector 6 is connected via the channel 7 and a choke or shut-off member (not shown) with the external gas source (not shown), so that the pressure in the gas collector rises until the control member 17 automatically opens the connection between the gas collector and the apertures 8. It is then still not yet possible for the gas to escape into the propulsive duct channel 2 as the apertures 8 are closed by the slider 4. However the pressure is transmitted via the bore 16 to the cylindrical chamber 15*a* where it acts on the piston surface 13*a* of the slider 4 and moves this forwards. After a short period the pressure also acts in the cylindrical chamber 15*b* on the surface 13*b*, so that the slider 4 is rapidly urged further forward until it reaches the position indicated in chain line, in which the aperture 5 of the propulsive duct is closed. At the same time the apertures 12 of the guide part 9 of the slider come into correspondence with the apertures 8, so that the power gas can escape out of the gas collector into the propulsive duct and push out rearwards the water contained in it in the manner of a piston. This means that the pressure sinks in the channel 2, until towards the end of the outthrust stroke it falls below the ambient pressure.

The return movement of the slider is initiated first of all by this underpressure, which acts on the rear surface of the thickened portion 22, and furthermore by the buffer overpressure which has built up on the front side of the piston 26 of the slider during the closure movement. At the end of the return movement the chamber 15*b*, which is formed by the piston surface 13*a* and the cylinder surface 13*b*, acts dampingly in the same manner as was described above with reference to FIG. 1 for the part of the chamber 24 located in front of the annular groove 23, since, that is to say, at the end of the return movement the chamber 15*b* is terminated by the channel 16 and thus becomes a buffer.

When the slider 4 has reached its rear, opened, position, the apertures 8 are closed again. The control member 17 has already returned into the closed position. The cycle of operations begins anew.

As the control member opens automatically when the gas pressure in the collector has reached a given value, the frequency and hence the power of the propulsive duct can be controlled by means of the rate of speed at which the gas collector is filled.

Figure 3:
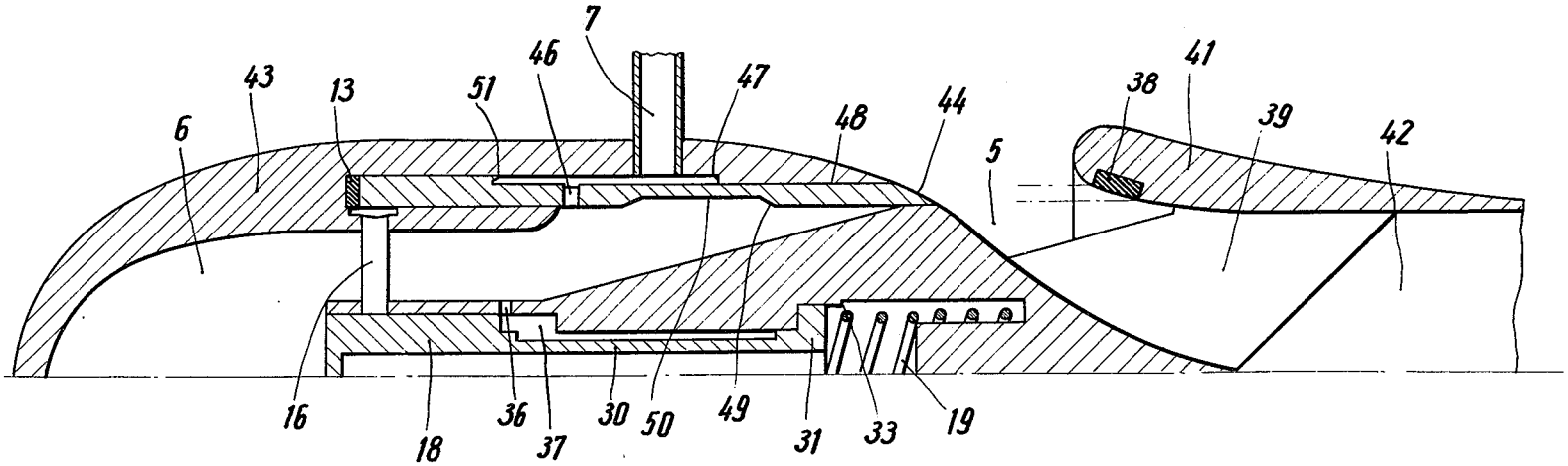
FIG. 3 is a corresponding section through the front part of a propulsive duct with body disposed in front.

FIG. 3 shows an arrangement in which the body 43, which contains the control and operating devices for the slider 44, is disposed in front of the front rim 41 of the propulsive duct 42. Similarly as in FIGS. 1 and 2, FIG. 3 is a half-representation of a rotationally-symmetrical arrangement.

The front rim 41 of the propulsive duct 42 is connected by means of a multiplicity of ribs 39 distributed round the periphery with the body 43 disposed co-axially to the propulsive duct 42 which contains the cylindrical slider 44 in a co-axial guideway and its drive devices. The slider is represented in the position which it assumes with the inlet aperture 5 opened. The closed position is indicated in chain line. The front rim of the slider co-operates sealingly in the closed position with an elastomeric ring 38 at the front rim 41 of the propulsive duct. In the opened condition of the inlet aperture 5 the front rim 41 of the propulsive duct and the part of the body 43 turned towards it, form flow-favouring contours both for the inflowing water and also for the water flowing past. In the closed condition the outer surface formed together by the body 43 and the propulsive duct 42 is complemented in the vicinity of the aperture 5 by the hollow-cylindrical slider 44 without seriously hindering the flow. Both in the open and in the closed condition of the aperture 5 the flow losses are therefore small. It is further apparent that the arrangement of the body 43 outside the propulsive duct 42 leads to more favourable flow conditions in the propulsive duct than in the case of the example of embodiment in FIGS. 1 and 2.

The arrangement of the slider 44 in relation to the front rim 41 of the propulsive duct could also be made such that the closed slider encompasses the rim or travels by its front end into a groove provided in the propulsive duct rim, which improves the sealing effect.

Inside the body 43 is located the gas collector 6, which is connected via a channel 7 and bores 46 in the slider 44 to an external power gas source (not shown). In the condition represented, in which the slider is located in the open position, communication between the gas collector 6 and the power gas source is also open. In the closed position of the slider the apertures 46 are however located in front of the control edge 47 of the body 43, so that communication between the gas collector and the power gas source is closed.

The front portion 48 of the slider has a radial thickness equivalent to the radial width of the guide slot provided for the slider in the body 43 adjacent to the aperture 5. In the position represented therefore the slider substantially seals off the gas collector 6 in respect of the ambient atmosphere. The axial length of the portion 48 is less than the length of the inlet aperture 5 measured in the direction of the slider. In the closed condition of the slider the rear edge 49 of the component 48 of the slider 44 therefore arrives in the vicinity of the aperture 5. As behind this edge there is located a recess 50 with a larger internal diameter, there is thus produced an annular slot between the slider and the slider guide member, forming a communication between the gas collector 6 and the front end of the closed propulsive duct, through which the gas contents under pressure of the gas collector can expand into the propulsive duct. The aperture cross-sectional area of this slot is sufficiently large for its resistance to be negligible in relation to the resistance due to the mass of water to be accelerated in the propulsive duct. Similarly as in the examples in FIGS. 1 and 2, here again the slider is connected to the overflow apertures for the pressure gas in the propulsive duct, so that the explanations given there can also be utilised here.

The control members are like those in FIG. 1. Corresponding components are given the same reference numerals. Reference is made to the explanations given in connection with FIG. 1.

The functioning of the propulsive duct drive represented in FIG. 3, when the pipe 7 is continuously connected to a power gas source, is therefore as follows. The pressure increases in the gas collector 6 until the control piston 17 frees the channel 16 to the rear piston surface 13 of the slider 44. The slider 44 closes abruptly. The gas content of the collector 6 expands into the propulsive duct and accelerates the water column located therein. The slider is accelerated back by the spring action of the gas enclosed between the shoulders 51 and 47. After the shoulder 51 has travelled over the aperture of the pipe 7 in the opening direction, the pressure in the pipe 7 acts on this shoulder and conveys the slider until it is in the open position. After the filling of the gas collector the cycle of operations is repeated.

Figure 4:
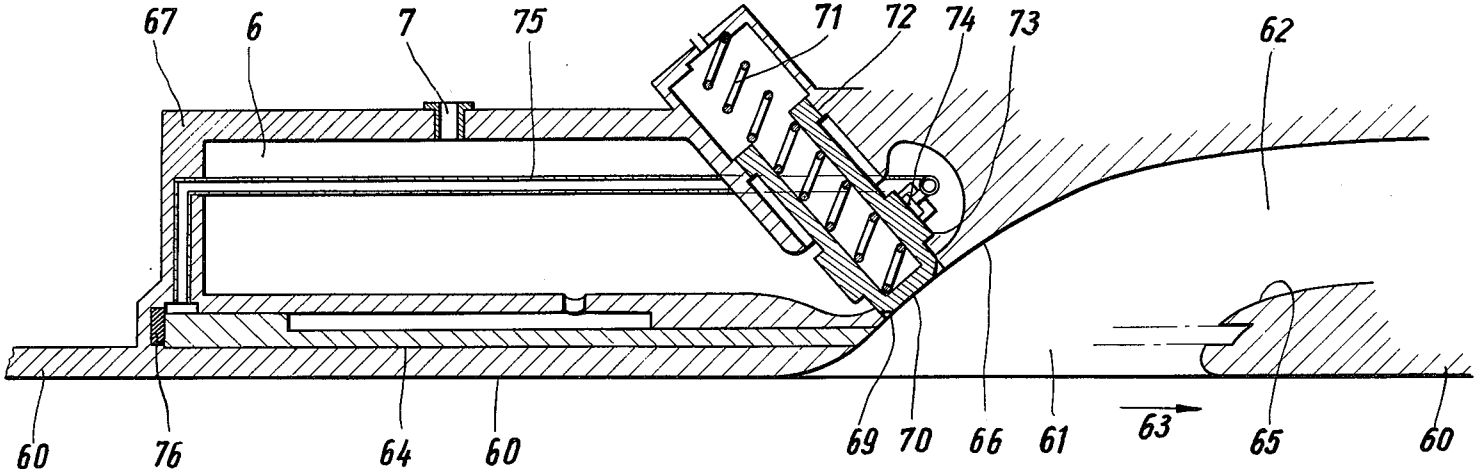
FIG. 4 is a longitudinal section through the front part of a propulsive duct which is disposed in the outer surface of a craft.

In FIG. 4 the outer wall 60 of a watercraft contains the inlet aperture 61 of the directly adjacent propulsive duct 62. At a slight distance away from the outer surface 30 and parallel to it, a flat slider 64 is supported in a guide member and permits a closed position indicated in chain line. When the slider 64 is closed water can flow past substantially undisturbed in the direction of the arrow 63. With the aperture 61 open favourable flow conditions are provided through the shape of the surfaces 65 and 66 forming the front end of the propulsive duct.

The body 67 forming the slider guide contains the gas collector 6, which is to be connected via connection member 7 with the power gas source. The gas collector 6 is connected via an aperture 69 with the front end of the propulsive duct which end is closed by a valve body 70 and source of spring power 71. The diameter of the aperture 69 and the associated valve component is somewhat less than the overall diameter of a piston component 72 of the valve body, which is guided in a cylindrical bore of the body 67. When the opposed force of the spring 71 overcomes the force exerted by the pressure in the gas collector 6 on the piston component 72, then the valve body 70 moves back. This means that a control edge 73 of the valve body travels across the access port 74 to a pipe 75 leading to the rear piston-type shaped end 76 of the slider 62, which is thus placed in communication with the pressure prevailing in the gas collector 6 and is abruptly transferred into the closure position. As the opening movement of the valve body 70 continues further the aperture 69 is completely opened and pressure gas flows out of the gas collector 6 into the propulsive duct.

We claim:

1. A propulsive duct for driving floatable craft comprising a longitudinal housing having a substantially circular cross-section and provided with a restricted inlet opening and an outlet opening at opposed ends thereof, a longitudinal insert body disposed coaxially within said housing and spaced therefrom to provide an annular duct diverging from the inlet opening and converging at the outlet opening, a hollow cylindrical sleeve-like member mounted coaxially within said insert body and slidable coaxially therein toward the restricted inlet opening in said housing, the diameter of said sleeve-like member being substantially the same as the inner diameter of the restricted inlet opening so that the end of the sleeve-like member will engage the restricted inlet opening to close the diverging annular passage between said housing and said insert body and means operable by a compressed gas for sliding said sleeve-like member to close the annular passage and for admitting the compressed gas into the annular passage to expel the liquid therein through the outlet opening.

2. A propulsive duct as claimed in claim 1 wherein the outer cylindrical surface at the outer end of the sleeve-like member engages the inner surface of the restricted inlet opening.

3. A propulsive duct as claimed in claim 2 wherein the inner surface of the end of the housing at the restricted inlet opening is rounded for engagement with the end of the sleeve-like member.

4. A propulsive duct as claimed in claim 3 and further comprising sealing means disposed at the end of the sleeve-like member for sealing engagement with the end of the housing at the inlet opening.

5. A propulsive duct as claimed in claim 1 and further comprising means for damping the movement of the sleeve-like member when approaching its fully closed and fully opened position.

6. A propulsive duct as claimed in claim 1 wherein said sleeve-like member is provided with means for controlling the admission of compressed gas into said annular passage when said sleeve-like member has closed the annular passage.

7. A propulsive duct as claimed in claim 6 wherein said longitudinal insert body is provided with a chamber for storing sufficient compressed gas for expelling substantially all of the liquid in the annular passage when said sleeve-like member closes the annular passage and further comprising means for returning the sleeve-like member to its open position after said gas has expelled the liquid from the annular passage.

8. A propulsive duct as claimed in claim 7 and further comprising means for cyclically controlling the admission of compressed gas to the chamber in said insert body.

9. A propulsive duct as claimed in claim 8 wherein said cyclically controlled means includes an opening provided in said sleeve-like member.

10. A propulsive duct as claimed in claim 1 wherein said sleeve-like member is provided with piston-like surfaces normal to the axis of said sleeve-like member and further comprises means for selectively subjecting said surfaces to the compressed gas for opening and closing said sleeve-like member.

11. A propulsive duct as claimed in claim 10 and further comprising means responsive to a predetermined gas pressure for admitting the gas to the piston like surfaces on said sleeve-like member for actuating said sleeve-like member.

12. A propulsive duct as claimed in claim 10 wherein said means for selectively subjecting said piston-like surfaces to the compressed gas includes biasing means.

* * * * *